US007556216B2

(12) United States Patent
Chandaria

(10) Patent No.: US 7,556,216 B2
(45) Date of Patent: Jul. 7, 2009

(54) POLARIZED TAPE DISPENSER

(75) Inventor: Ashok V. Chandaria, Nairobi (KE)

(73) Assignee: Kitaru Innovations Inc., Lascelles, St. James (BB)

( * ) Notice: Subject to any disclaimer, the term of this patent is extended or adjusted under 35 U.S.C. 154(b) by 0 days.

(21) Appl. No.: 12/022,574

(22) Filed: Jan. 30, 2008

(65) Prior Publication Data

US 2008/0116313 A1 May 22, 2008

Related U.S. Application Data

(60) Division of application No. 11/360,133, filed on Feb. 22, 2006, now Pat. No. 7,367,523, which is a continuation of application No. 10/651,514, filed on Aug. 28, 2003, now Pat. No. 7,036,765.

(60) Provisional application No. 60/460,581, filed on Apr. 4, 2003.

(51) Int. Cl.
*B65H 16/00* (2006.01)

(52) U.S. Cl. ..... 242/588.6; 242/613

(58) Field of Classification Search ..... 242/588.6, 242/596.7, 599.3, 613, 612, 599.4, 160.4, 242/912, 609, 611.2, 613.5
See application file for complete search history.

(56) References Cited

U.S. PATENT DOCUMENTS

| | | | | | |
|---|---|---|---|---|---|
| 1,962,959 | A * | 6/1934 | Kinloch | ..... | 242/160.4 |
| 2,295,679 | A * | 9/1942 | Montbach | ..... | 225/25 |
| D164,733 | S * | 10/1951 | Pretzfelder, Jr. | ..... | D19/69 |
| 3,126,234 | A * | 3/1964 | Batlas et al. | ..... | 242/596.7 |
| 3,438,589 | A | 4/1969 | Jespersen | | |
| 4,060,444 | A * | 11/1977 | Schweig et al. | ..... | 206/394 |
| 4,383,656 | A | 5/1983 | Campbell | | |
| 4,479,615 | A | 10/1984 | Nakajima et al. | | |
| 4,522,346 | A | 6/1985 | Jespersen | | |
| 4,659,031 | A * | 4/1987 | Saraisky | ..... | 242/613.5 |
| 5,249,755 | A | 10/1993 | Jespersen | | |
| 5,356,093 | A * | 10/1994 | Kewin | ..... | 242/613.5 |
| 5,595,356 | A * | 1/1997 | Kewin | ..... | 242/613.5 |
| 6,390,428 | B1 * | 5/2002 | Oshima | ..... | 242/613.5 |
| 6,948,673 | B1 * | 9/2005 | Sato | ..... | 242/160.4 |
| 7,051,971 | B2 * | 5/2006 | Takeda et al. | ..... | 242/578.2 |
| 7,367,523 | B2 * | 5/2008 | Chandaria | ..... | 242/588.6 |

* cited by examiner

*Primary Examiner*—William A Rivera
(74) *Attorney, Agent, or Firm*—Sand & Sebolt

(57) ABSTRACT

A tape dispenser having a frame and a pair of opposed, unequal diameter hub mounts for rotatably mounting an adhesive tape roll thereon. A hub is provided for supporting the roll of tape thereon and for engaging the hub mounts. The hub comprises a generally cylindrical body having open ends of equal diameter. The diameter of these ends is large enough to engage the larger diameter hub mount but is too large to engage the smaller diameter hub mount. A ring adaptor is provided for insertion into one of the ends to effectively reduce the internal diameter of that end. The hub can therefore be oriented so that the adhesive side of the tape supported thereon will be facing downwardly when dispensed. The adaptor is inserted into the appropriate end of the hub body so that the hub is configured to engage the two unequal diameter hub mounts.

17 Claims, 13 Drawing Sheets

POLARIZED TAPE DISPENSER

CROSS REFERENCE TO RELATED APPLICATIONS

This application is a divisional of U.S. patent application Ser. No. 11/360,133, filed Feb. 22, 2006, which is a continuation of U.S. patent application Ser. No. 10/651,514, filed Aug. 28, 2003, now U.S. Pat. No. 7,036,765; which claims priority from U.S. Provisional Application Ser. No. 60/460,581, filed Apr. 4, 2003, the entire disclosures of which are incorporated herein by reference.

BACKGROUND OF THE INVENTION

1. Technical Field

The invention relates to tape dispensers. More particularly, the invention relates to hand-held tape dispensers adapted to dispense adhesive tape. Specifically, the invention relates to a hand-held tape dispenser that has a polarized hub configuration to prevent the user from installing the tape roll in an inverted, incorrect orientation on the supporting frame.

2. Background Information

There are numerous types of adhesive tapes that have a wide variety of uses. A frequently used type of adhesive tape is packaging tape that is used to secure the flaps of boxes and packages for shipping. This type of tape is typically two inches wide and is fairly difficult to pull off a roll by hand and maneuver it into position around the package. Industrial hand-held tape dispensers have been proposed in the prior art for applying such wide adhesive tape. Many of these devices, however, experience a number of problems in their usage, one of which is the correct position of the roll of adhesive tape on the frame so that the adhesive side of the tape is properly oriented for correctly dispensing the tape from the dispenser onto a package or other surface.

These prior art hand-held and operated tape dispensers usually include a frame formed of metal or plastic, which have a pair of axially opposed mounting hubs on which a hub of the roll of tape is engaged for rotatably mounting the roll of tape on the frame. These hub mounts are similar in shape and size, as well as the axial end openings of the hub of the reel of tape so that, unless the operator pays particular attention to the orientation of the adhesive side of the tape, it could be facing in the wrong direction for proper use of the dispenser when mounted on the hub mounts within the dispenser frame.

Also, for certain applications, it is desirable that a particular type of tape be used with a particular dispenser intended to be used for a particular type of job application. Dispenser having the same size hub mounts and corresponding tape hubs make such a restriction difficult.

Therefore, the need exists for an improved combination tape dispenser frame and tape roll hub, which is polarized, that is, it induces polarization to the combination to insure correct orientation of the tape reel on the frame, so that the adhesive side of the tape is oriented properly.

BRIEF SUMMARY OF THE INVENTION

The device of the present invention is a tape dispenser that has a frame, a cutter blade at a forward end thereof, and a tape roll rotatably mounted on the frame, and in particular, a polarized dispenser, that is a dispenser in which the hub mounts on the frame are of different sizes in order to require a correct orientation with the hub openings on which the tape roll is mounted, to insure proper orientation of the tape roll on the frame so that the adhesive side of the tape is oriented in a proper direction for correct dispensing of the tape therefrom.

Another feature of the improved tape dispenser is molding the tape roll hub as a one-piece member, enabling it to be manufactured more economically by eliminating secondary assembly of multiple components.

A further feature of the invention is to form the hub as a two or three component member, which enables existing hubs to be utilized requiring only a separate polarizing ring to be formed and mounted thereon, which enable the hubs to be compatible with current tape winding machinery and methodology.

Another feature of the invention is to use two standard wide tape hubs having recessed center cores enabling it to be compatible with current tape winding machinery.

Still another feature of the invention is to enable the dispenser frame and tape roll hubs to be molded inexpensively of plastic material in various widths, which provides for a relatively simple and durable tape dispenser, yet one which insures correct orientation of the tape roll on the frame for proper positioning of the adhesive side of the tape to insure that the dispenser is used as intended.

BRIEF DESCRIPTION OF SEVERAL VIEWS OF THE DRAWINGS

Preferred embodiments of the invention, illustrative of the best modes in which applicant contemplates applying the principles, are set forth in the following description and are shown in the drawings and are particularly and distinctly pointed out and set forth in the appended claims.

Similar numbers refer to similar parts throughout the drawings.

DETAILED DESCRIPTION OF THE INVENTION

Figure 1:
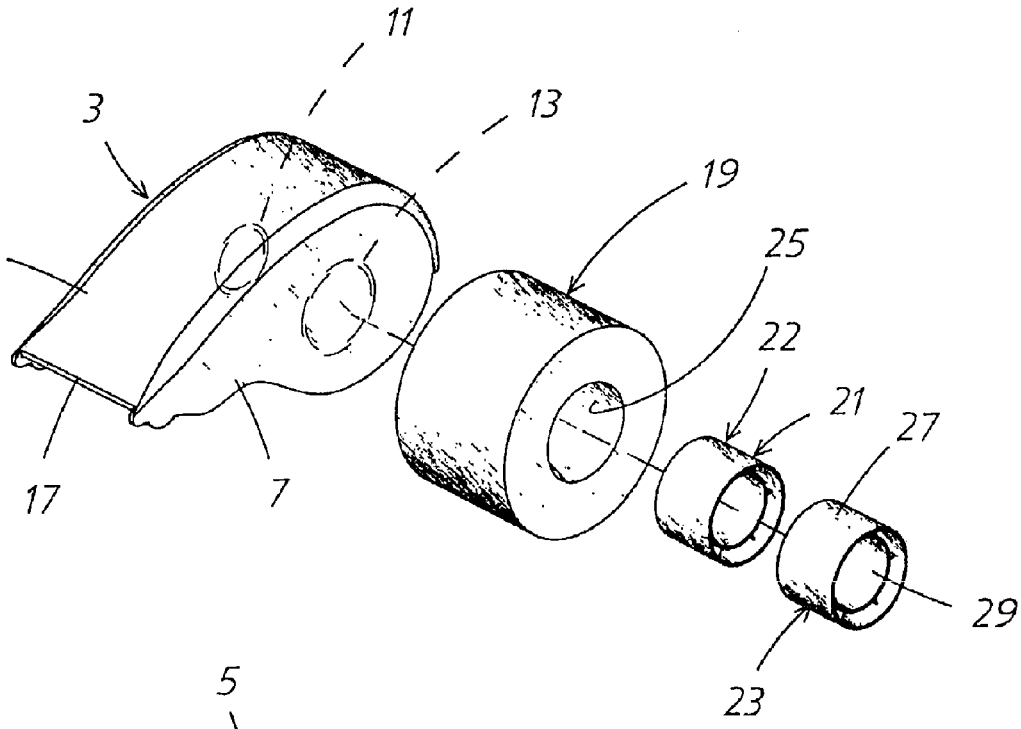
FIG. 1 is an exploded perspective view of a first embodiment of the polarized tape dispenser.
Figure 2:
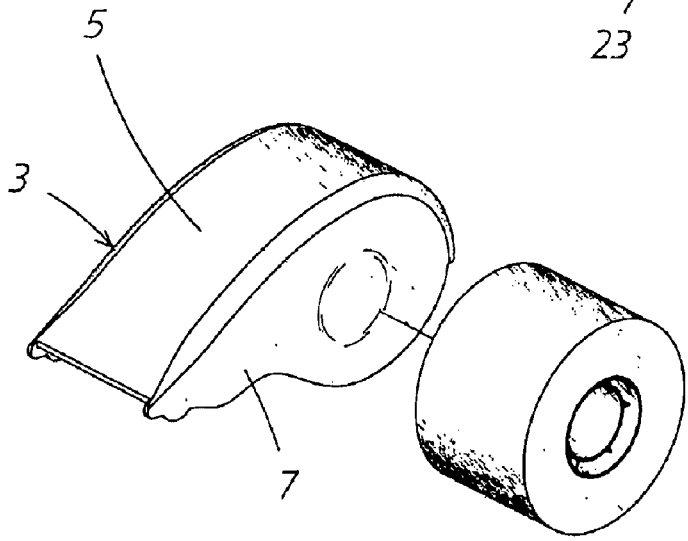
FIG. 2 is a partially exploded perspective view similar to FIG. 1 showing the two-piece hub mounted within the tape roll.
Figure 3:
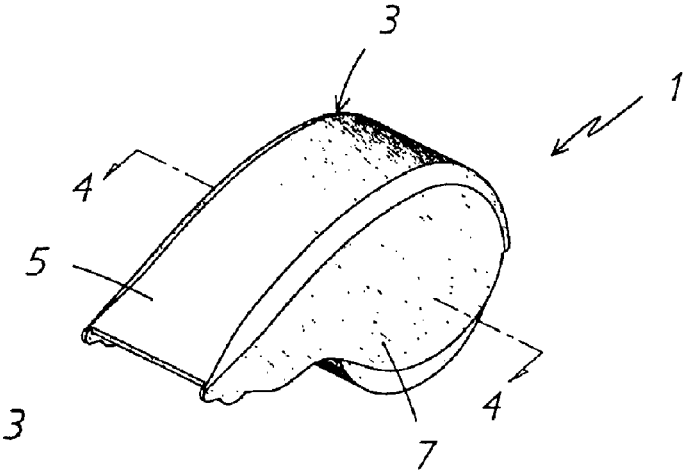
FIG. 3 is an assembled view of the tape dispenser of FIGS. 1 and 2.
Figure 4:
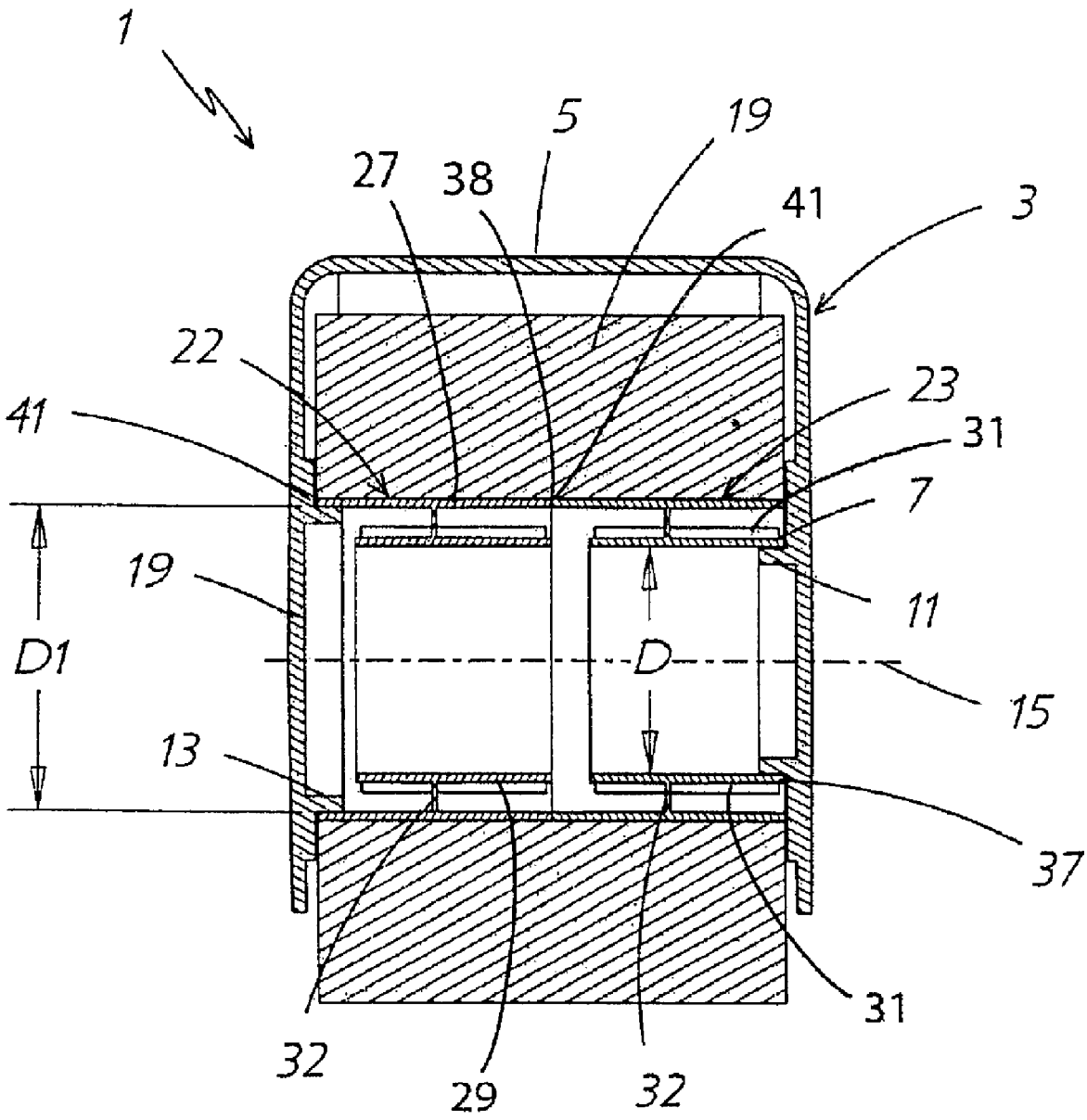
FIG. 4 is an enlarged cross-sectional view of the tape dispenser taken on line 4-4, of FIG. 3.
Figure 5:
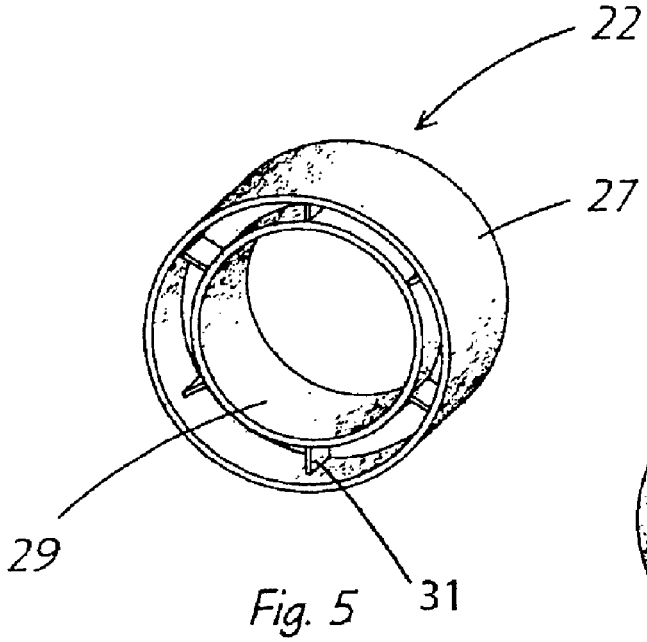
FIG. 5 is a side perspective end view of one of the hub members of FIGS. 1-4.
Figure 6:
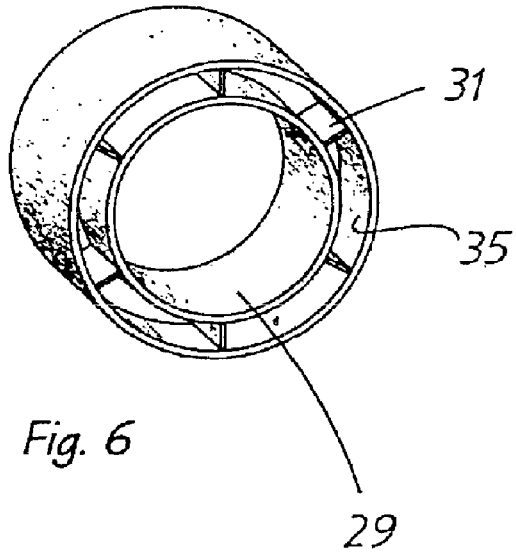
FIG. 6 is a side perspective end view of the hub member of FIG. 5.
Figure 7:
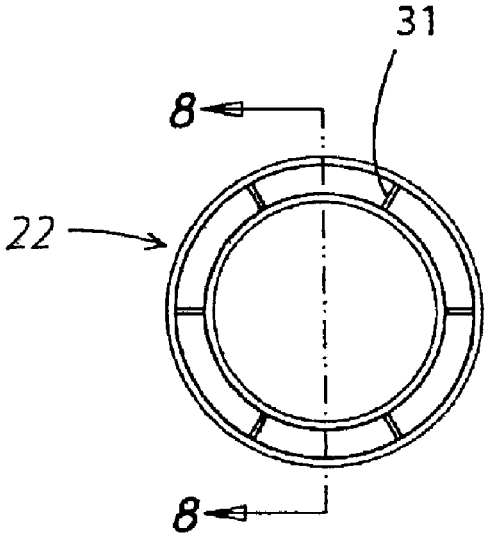
FIG. 7 is an end elevational view of the hub member of FIGS. 5 and 6.

FIGS. 1-8 show a first embodiment of the improved tape dispenser, which is indicated generally at 1. Tape dispenser 1 includes a frame indicated generally at 3. Frame 3 includes a curved upper wall 5 and a pair of curved irregularly-shaped side walls 7 and 9, each of which is formed with a hub mount 11 and 13, respectively, which extend inwardly toward each other as shown in FIG. 4. Each hub mount has an annular configuration and has their centers lie on a common axis 15. In accordance with one of the features of the invention, hub mount 11 is of a smaller diameter than that of hub mount 13 as shown particularly in FIG. 4. The configuration of frame 3 is similar to commonly used tape dispensers, but has the unique feature of the unequal hub mounts, preferably formed integrally thereon. Preferably, frame 3, including the hub mounts, is a one-piece member molded inexpensively of plastic material, and may have a serrated blade (not shown) mounted or formed on a discharge end 17 of curved upper wall 5.

Figure 8:
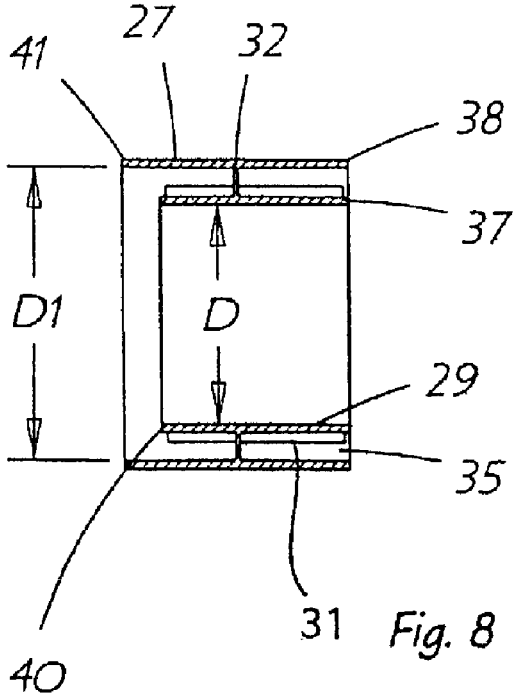
FIG. 8 is a sectional view taken on line 8-8, FIG. 7.
Figure 9:
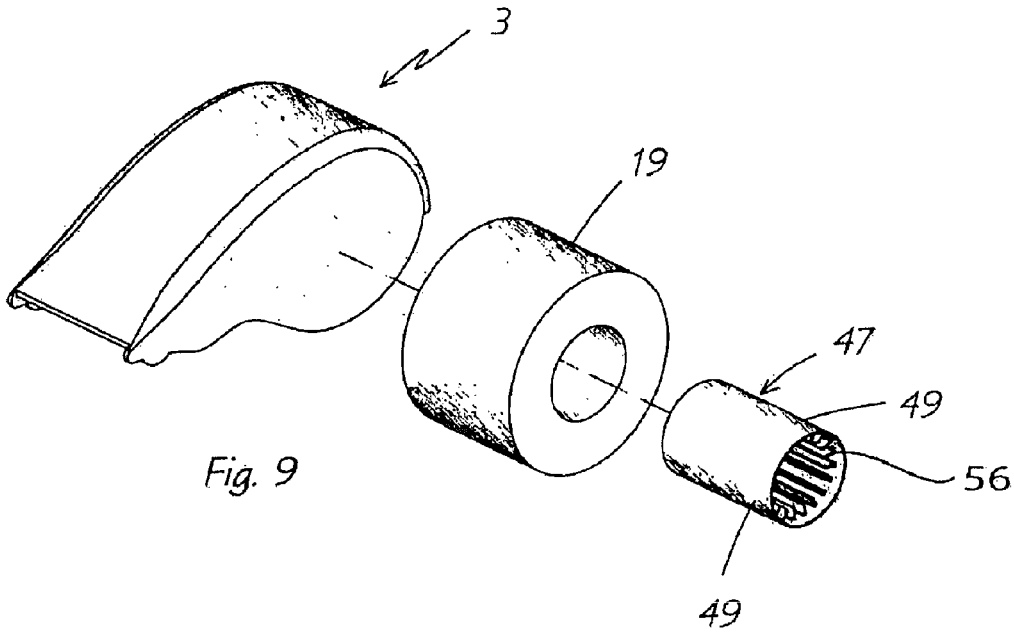
FIG. 9 is an exploded perspective view of a second embodiment of the polarized tape dispenser.
Figure 10:
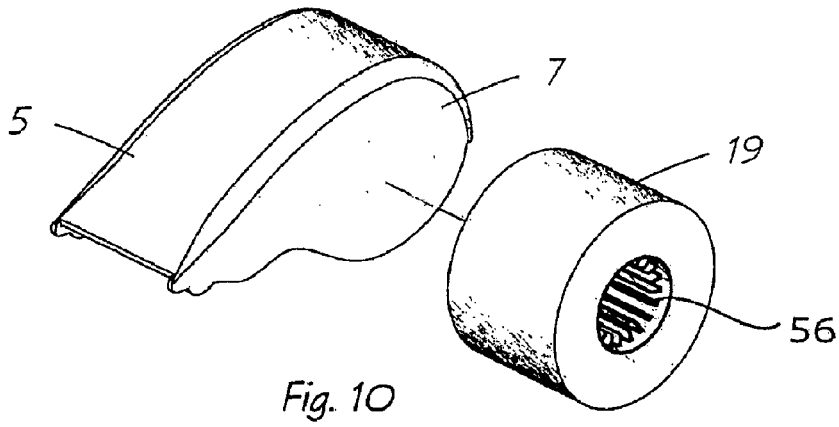
FIG. 10 is a partially exploded perspective view showing the one-piece hub member of FIG. 9 assembled with the tape roll.
Figure 11:
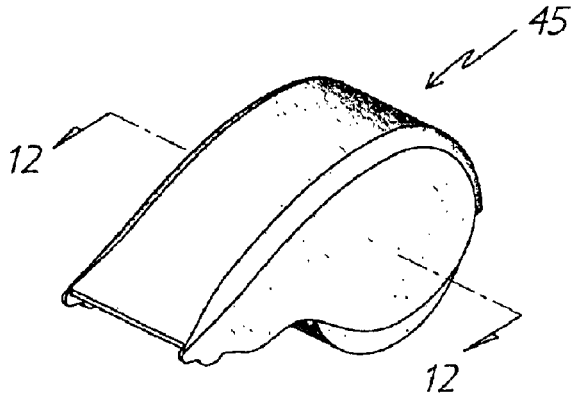
FIG. 11 is an assembled view of the tape dispenser of FIGS. 9-10.

In further accordance with the invention, a tape roll 19, which is of a usual construction having an adhesive on one side thereof, is mounted on a hub indicated generally at 21. Hub 21 of embodiment 1 includes a pair of hub members 22 and 23 (FIGS. 5-8), which are substantially identical to each other, and which receive the layers of tape thereon to form tape roll 19. Therefore, only hub member 22 is shown in detail in FIGS. 5-8. Each hub member 22 and 23 has an outer cylindrical wall 27 on which the adhesive tape is wound and layered and includes an internal reduced diameter inner annular core 29, which is connected to outer wall 27 by a plurality of radially extending flanges or reinforcing ribs 31, and in addition, may include a circumferentially extending radially outwardly projecting flange 32. As shown in FIG. 8, inner annular core 29 has an inner diameter D which is complementary to the outer diameter of hub mount 11 so as to form a complementary sliding engagement therewith as shown in FIG. 4. Outer wall 27 has an internal diameter $D_1$ which is equal to the outer diameter of hub mount 13. Furthermore, as shown in FIG. 8, inner core 29 is concentrically located within the hollow bore 35 of outer wall 27, but is offset axially with respect thereto so that one circular edge 37 of core 29 is radially aligned with circular edge 38 of outer wall 27, with the opposite circular edge 40 of inner core 29 being spaced axially inwardly from circular edge 41 of outer wall 27. Thus, as shown in FIG. 4, circular edge 38 of hub member 22 is abutted against circular edge 41 of hub member 23 to provide for a continuous outer cylindrical surface on which tape roll 19 is wound. Outer circular edge 37 of hub member 23 extends over hub mount 11, and the outer extended edge 41 of outer cylindrical wall 27 of hub member 22 slides over the annular surface of hub mount 13. Thus embodiment 1 includes two similar or identical hub members 22 and 23 that form hub 21, which members are placed in axial abutting relationship as shown in FIG. 4, with one of the exposed ends having a diameter D, provided by inner bore 29, which is slidably mounted over hub mount 11, with inner diameter $D_1$ of outer cylindrical wall 27 being complementary to the outer diameter of hub mount 13, and is slidably engageable therewith to rotatably mount tape roll 19 on frame 3.

Should a user attempt to place tape roll 19, and in particular hub 21, incorrectly on frame 3, it would provide for a tilted, extremely loose fit thereon which will be recognized immediately by the user that it is incorrectly installed. By placing tape roll 19 in the correct position on frame 3, the adhesive side of the tape will be properly oriented for correct usage of tape dispenser 1.

Figure 12:
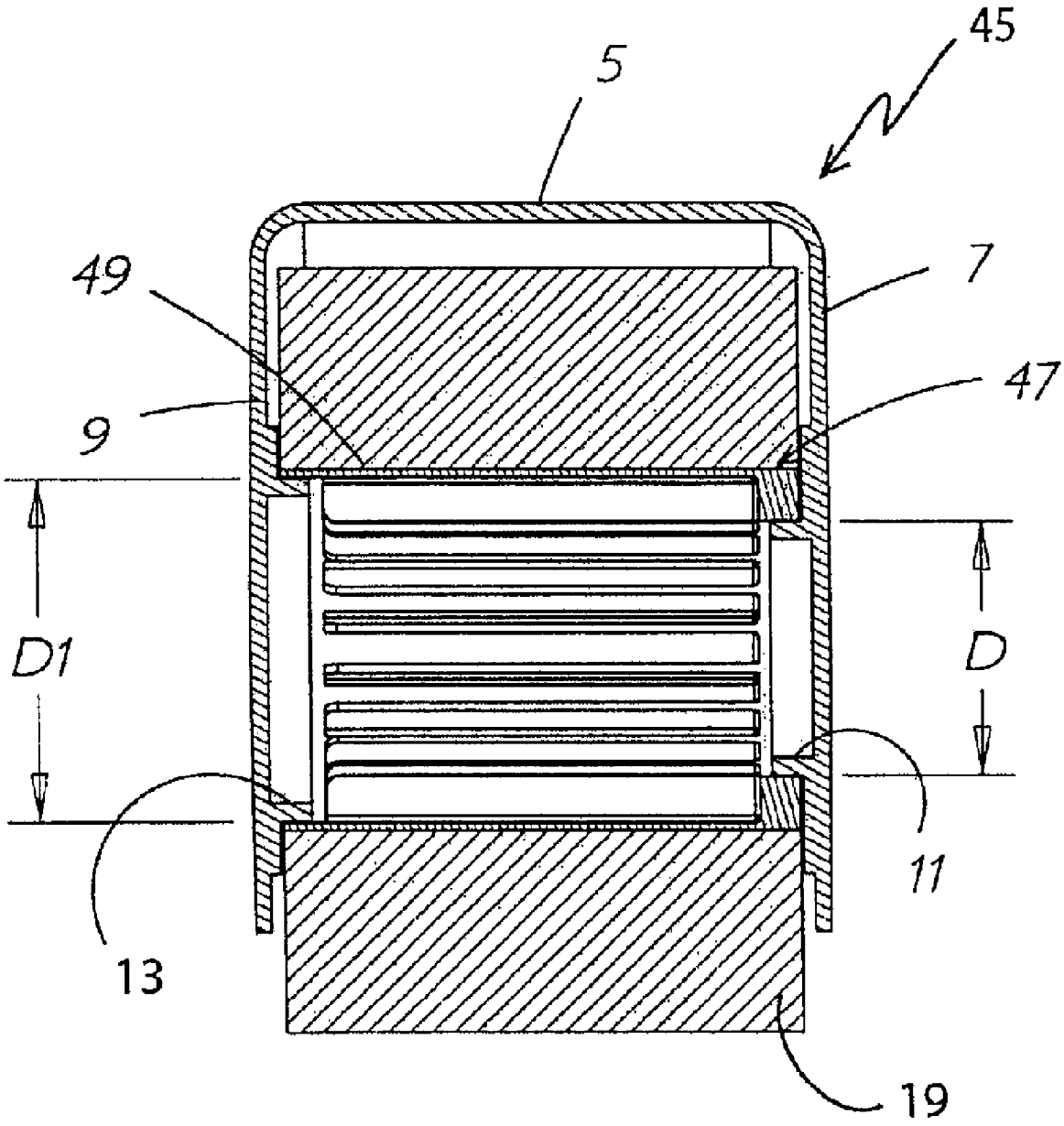
FIG. 12 is an enlarged sectional view taken on line 12-12, FIG. 11.
Figure 13:
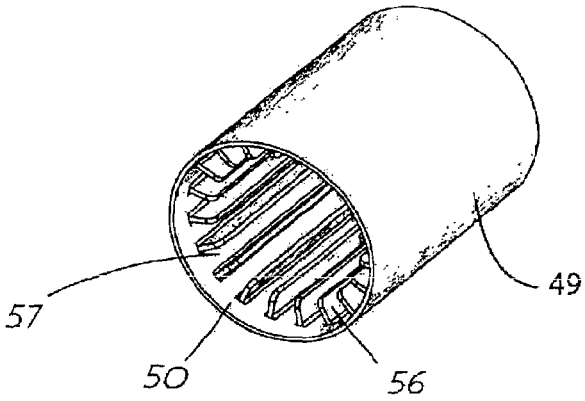
FIG. 13 is a perspective view of one end of the hub of FIGS. 9-12.
Figure 14:
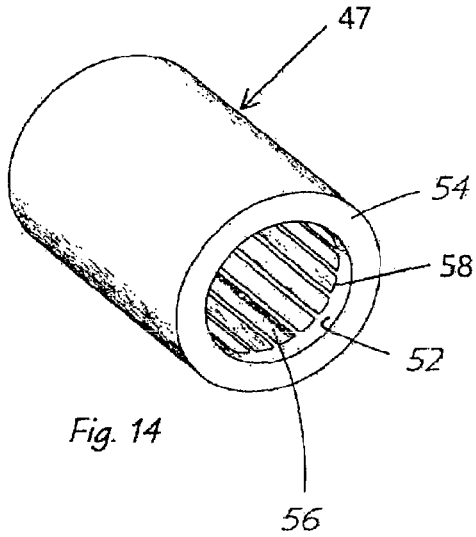
FIG. 14 is a perspective view of the opposite end of the hub of FIG. 13.
Figure 15:
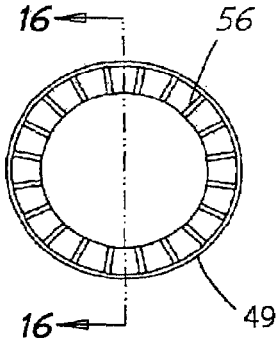
FIG. 15 is an end elevational view of FIG. 13.
Figure 16:
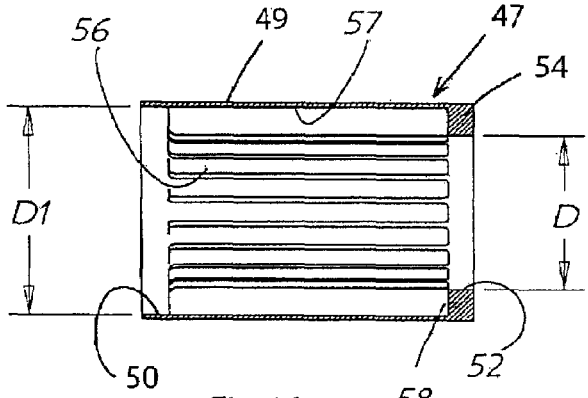
FIG. 16 is a sectional view taken on line 16-16, FIG. 15.
Figure 17:
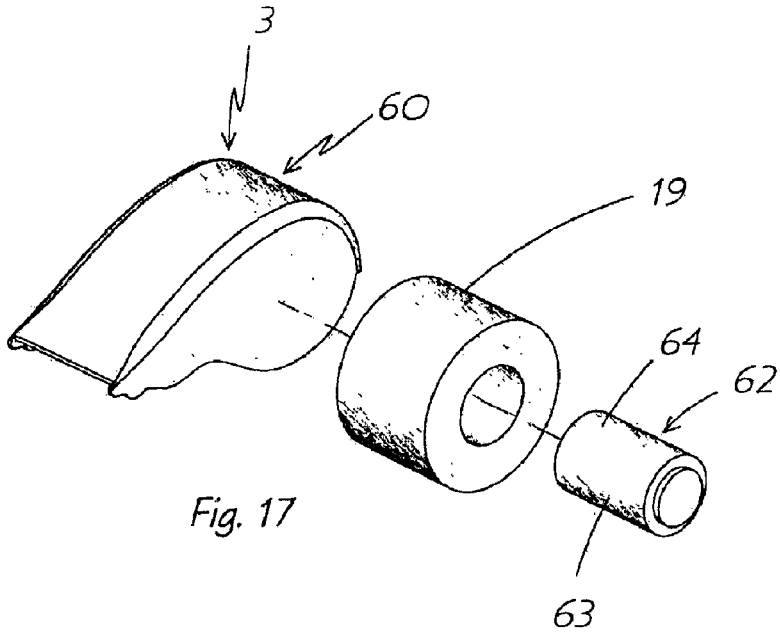
FIG. 17 is an exploded perspective view of a third embodiment of the polarized tape dispenser.
Figure 18:
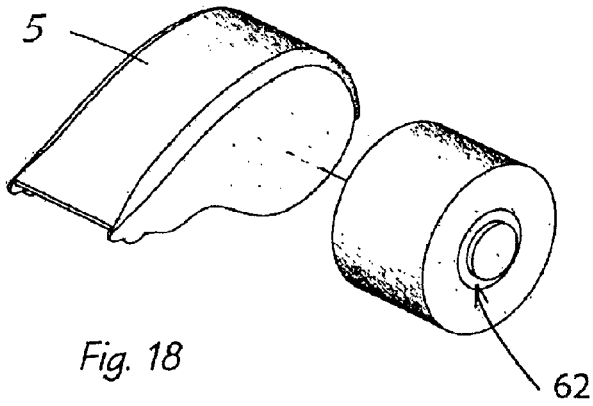
FIG. 18 is a partial exploded perspective view of the hub mounted within the tape roll of FIG. 17.
Figure 19:
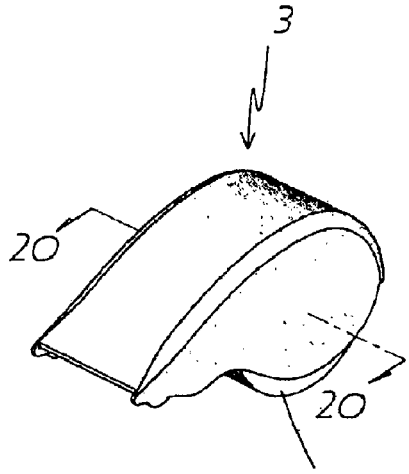
FIG. 19 is an assembled perspective view of the tape dispenser of FIGS. 17-18.

A second embodiment of the improved tape dispenser is indicated generally at 45, and is shown in FIGS. 9-16. Embodiment 45 includes a tape roll 19 and frame 3, and includes a one-piece hub indicated generally at 47. Hub 47 includes a cylindrical outer wall 49, which has a first open end 50 with an inner diameter $D_1$ (FIG. 12) complementary to the outer diameter of hub mount 13. Also, as is shown particularly in FIGS. 14-16, outer wall 49 terminates in a second open end 52 formed by an inwardly extending annular flange 54 having an open diameter D, which again, is complementary to the outer diameter of hub mount 11 (FIG. 12). A plurality of radially extending reinforcing flanges or ribs 56 are spaced circumferentially about inner surface 57 of cylindrical wall 49. Ribs 56 extend only partially toward the central axis of hub 47, and terminate an axial distance inwardly from open end 50, a distance at least equal to and preferably slightly greater than the axial length of hub mount 13, and at open end 52 terminate adjacent the inside annular surface 58 of flange 54 as shown in FIGS. 12 and 16. Again, the two different diameters provided by open ends 50 and 52, which are complementary to hub mounts 13 and 11, respectively, insure that the tape reel, and in particular hub 47, can be installed in only one manner on frame 3. The one-piece configuration of hub 47 provides for a reduction in the number of components required with respect to that of the pair of hub members 22 and 23 of hub 21, which may reduce manufacturing cost and any secondary assembly processes, but require that they be oriented correctly while the tape is applied thereto.

Figure 20:
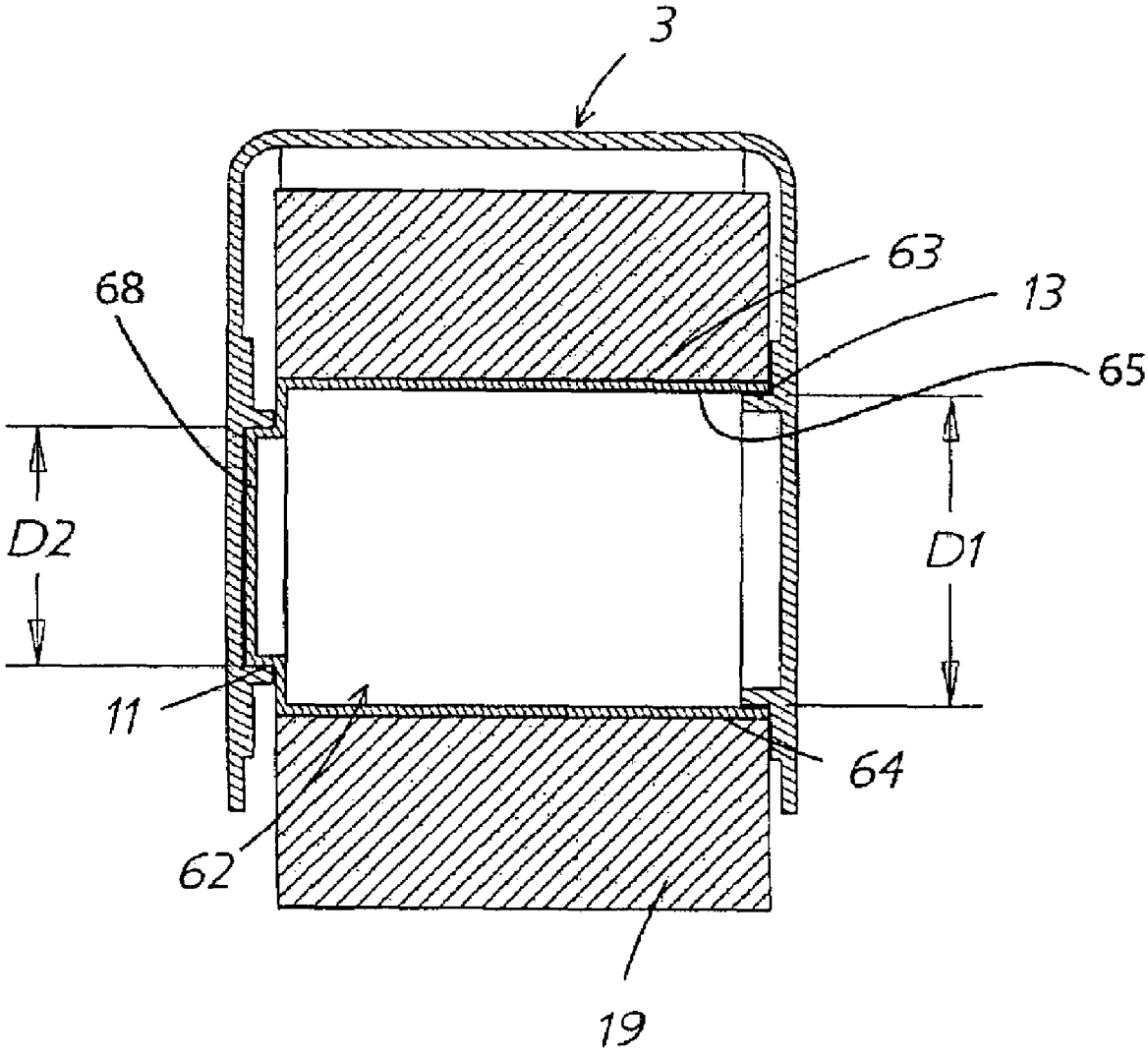
FIG. 20 is an enlarged sectional view taken on line 20-20, FIG. 19.
Figure 21:
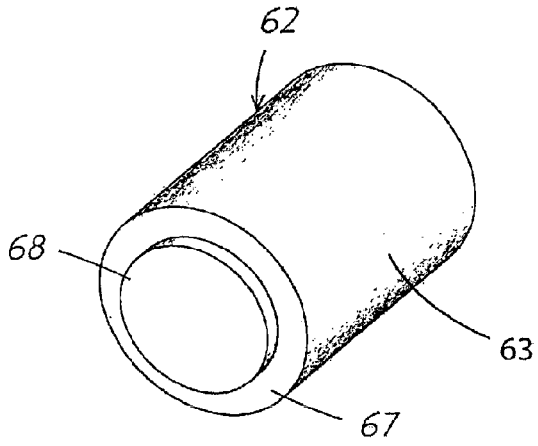
FIG. 21 is a perspective view of one end of the hub of FIGS. 17-20.
Figure 22:
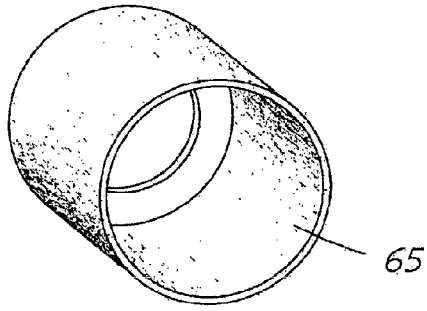
FIG. 22 is a perspective view of the opposite end of the hub of FIG. 21.
Figure 23:
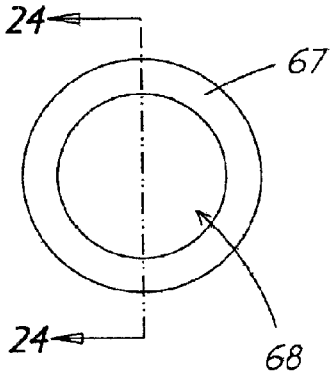
FIG. 23 is an end elevational view of FIG. 21.
Figure 24:
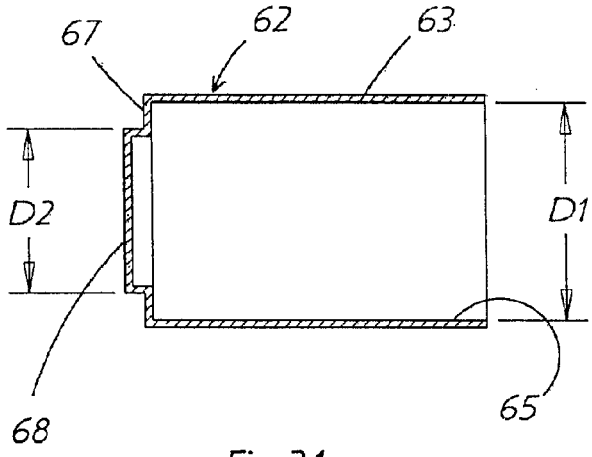
FIG. 24 is a sectional view taken on line 24-24, FIG. 23.

A third embodiment of the improved tape dispenser is indicated generally at 60 and is shown in FIGS. 17-24. Embodiment 60 includes frame 3 and tape roll 19, and includes a one-piece hub indicated generally at 62. Hub 62 includes a main cylindrical body 63 having a cylindrical outer surface on which the tape is wound as shown in FIG. 20. In accordance with the invention, the inside diameter of hub 62 to, and in particular, open end 65 of body 63 is indicated at $D_1$, which again is complementary to the outside diameter of hub mount 13. The opposite end of hub 62 has an inwardly extending annular flange 67, which terminates in an outwardly extending cylindrical-shaped boss 68, which has an outer diameter $D_2$ which equals the inside diameter $D_2$ of hub mount 11. As shown in FIG. 20, diameter $D_1$ of open end 65 slidably engages the outer cylindrical surface of hub mount 13, with the outer annular surface of cylindrical boss 68 having a diameter $D_2$, is slidably received within the annular opening provided by hub mount 11, which has a complementary interior diameter $D_2$ Thus, again, hub 62, due to its polarized hub, insures that the tape roll can be mounted satisfactorily in only one manner on spaced hub mounts 11 and 13 of frame 3 as shown in FIG. 20 to insure that the adhesive side of the tape is properly oriented. Also, hub 62 provides for a single component which can be manufactured economically preferably of plastic material, on which the tape is wound, after which it can be mounted only in one manner on frame 3.

Figure 25:
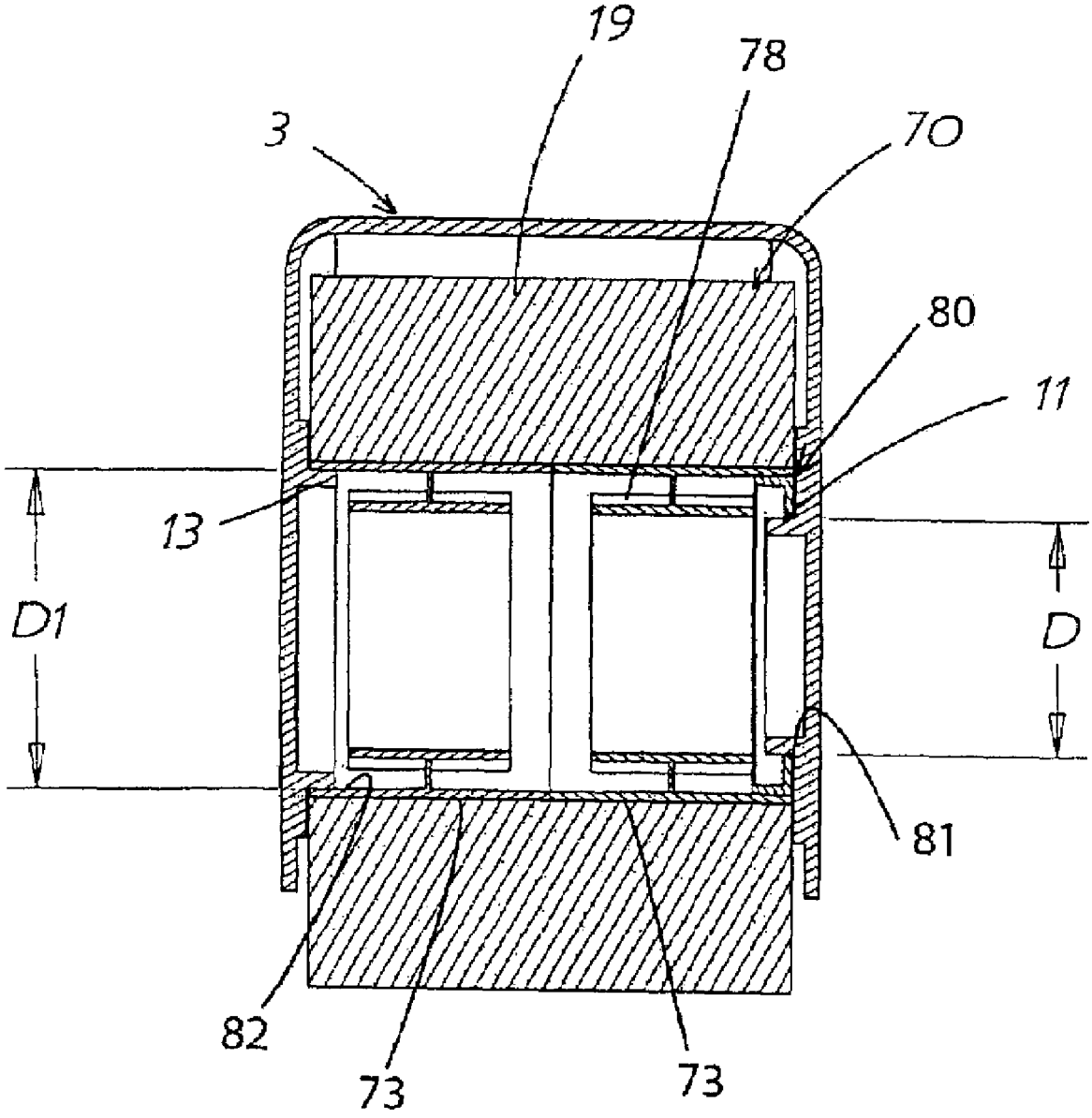
FIG. 25 is an enlarged sectional view of a fourth embodiment of the tape dispenser that is similar to FIGS. 4, 12, and 20.
Figure 26:
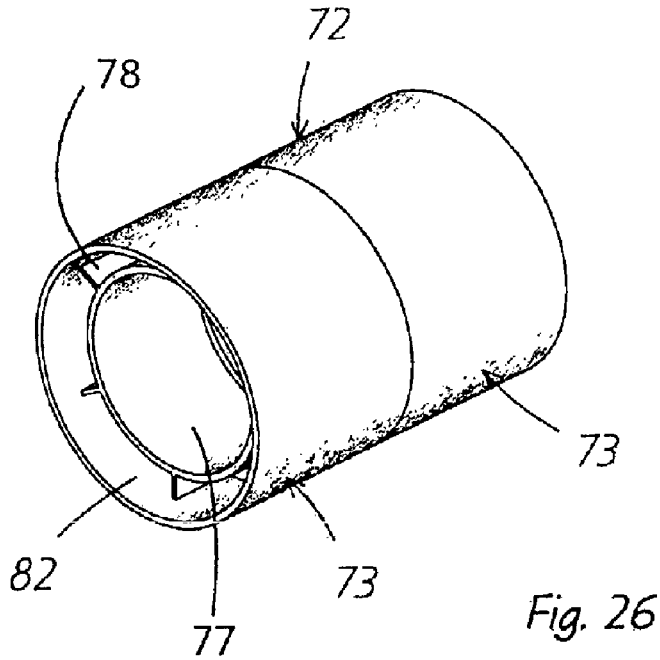
FIG. 26 is a perspective view of the three-piece hub removed from the tape dispenser of FIG. 25.
Figure 27:
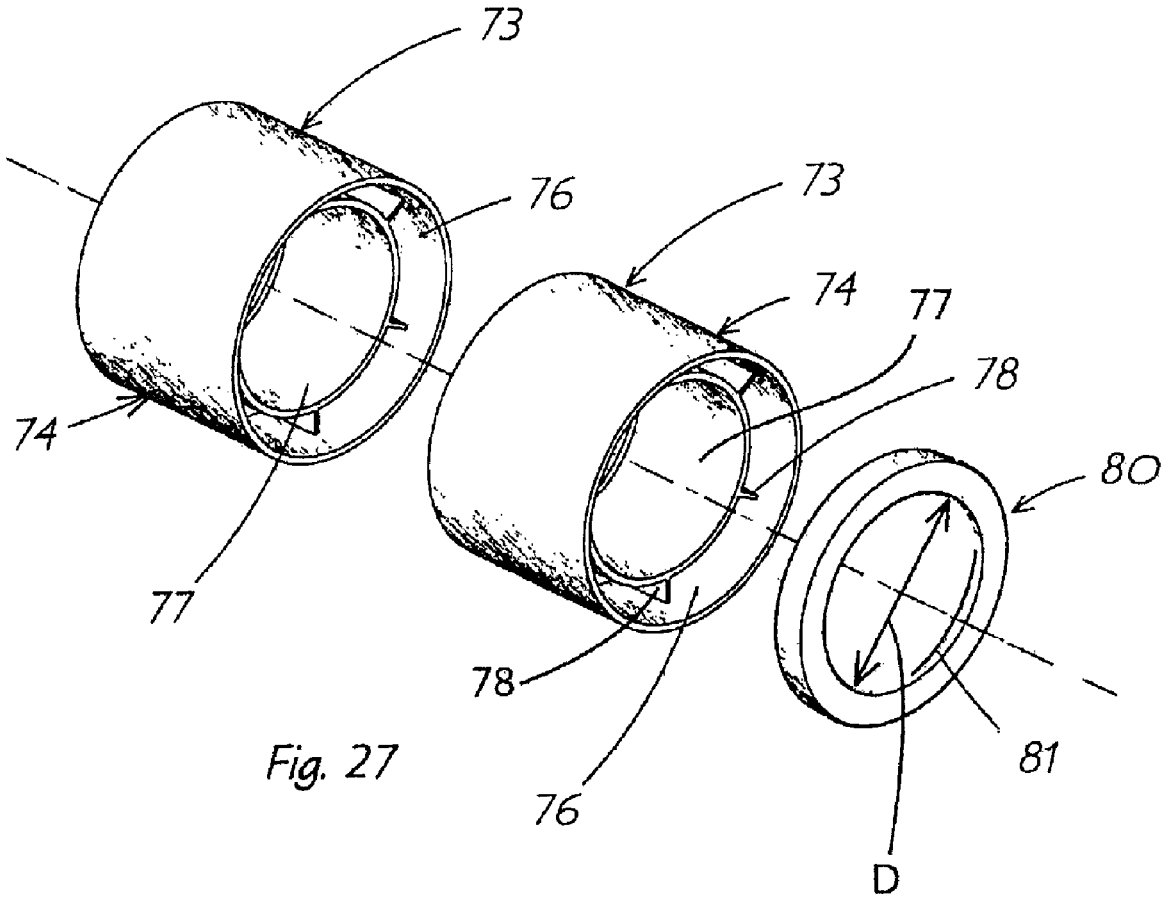
FIG. 27 is an exploded view of the three-piece hub of FIG. 26.

A fourth embodiment of the improved tape dispenser is shown in FIGS. 25-27, and indicated generally at 70. Embodiment 70 includes a usual tape roil 19 and a three-piece hub indicated generally at 72. Hub 72 includes a pair of identical hub members 73, each of which includes an outer cylindrical body 74 having a cylindrical outer surface on which the tape is wound, and a cylindrical inner surface 76, and a cylindrical inner core 77 located concentrically with respect to outer body 74. A plurality of radially extending flanges 78 extend between inner core 77 and outer body 74. An annular end member 80 has an open end 81 with a diameter D. End member 80 has an outer diameter complementary to the inner diameter $D_1$ of cylindrical body 74 and is telescopically engaged therein as shown in FIG. 25. Thus, an open end 82 of one hub member 73 has an internal diameter $D_1$, which is complementary to the outer diameter of hub mount 13 and is telescopically slidably engaged about hub mount 13, with hub mount 11 being slidably engaged within open end 81 of end member 80, again, to insure the correct mounting of tape roll 19 on frame 3 as shown in FIG. 25.

Embodiment 70 enables identical hub members to be produced and utilized, thereby reducing inventory cost and manufacturing costs, but does require a second component in annular end member 80, which requires another procedure for mounting it within the open end of one of the hub members. Again, flanges 78 terminate axially inwardly from the peripheral edge of the hub members a sufficient distance to permit the insertion of end member 80 in one end thereof, and the insertion of hub mount 13 in an opposite end of the other hub member as shown in FIG. 25.

Figure 28:
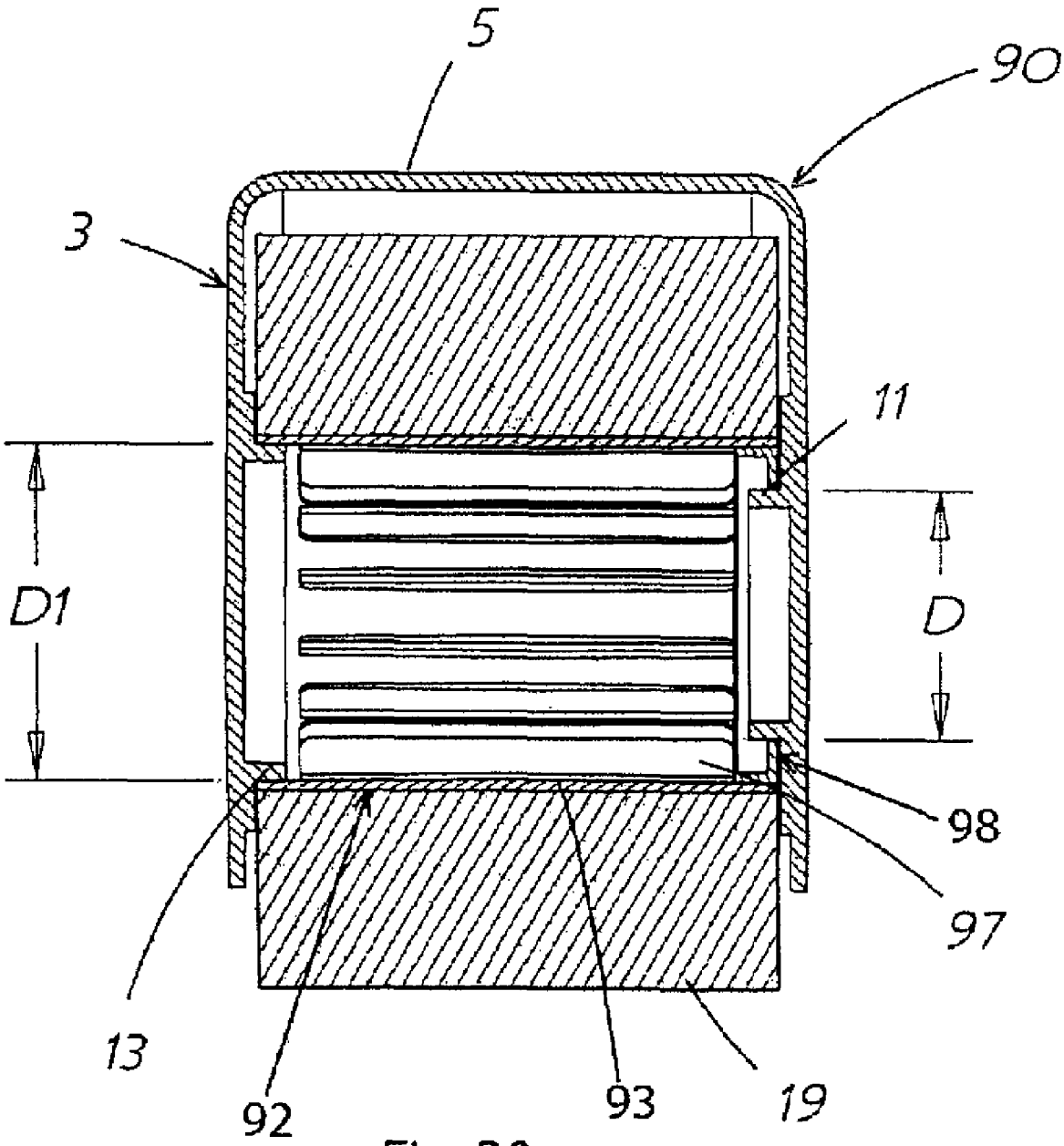
FIG. 28 is a perspective view of a fifth embodiment of the tape dispenser that is similar to FIGS. 4, 12, 20, and 25.
Figure 29:
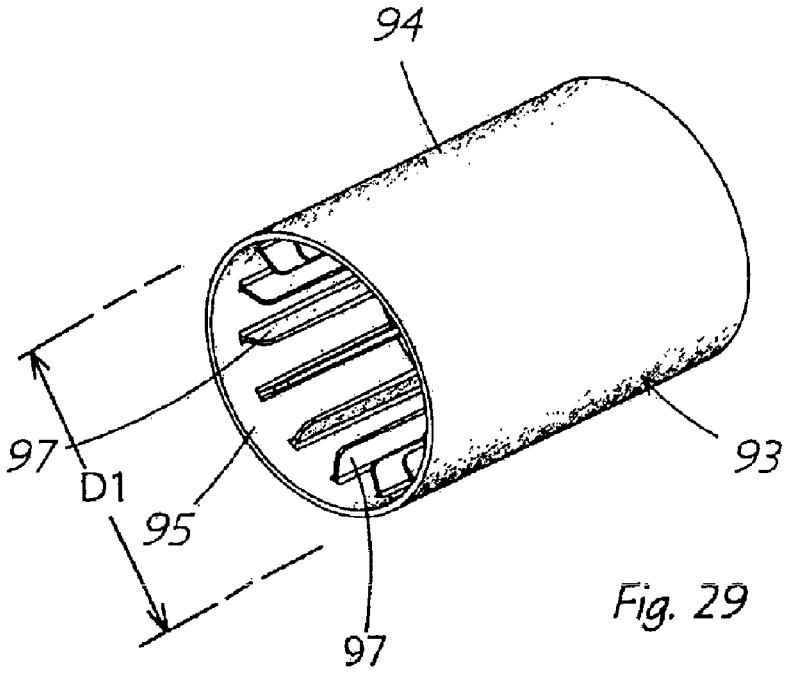
FIG. 29 is a view of one end of the hub for a fifth embodiment of FIG. 28.
Figure 30:
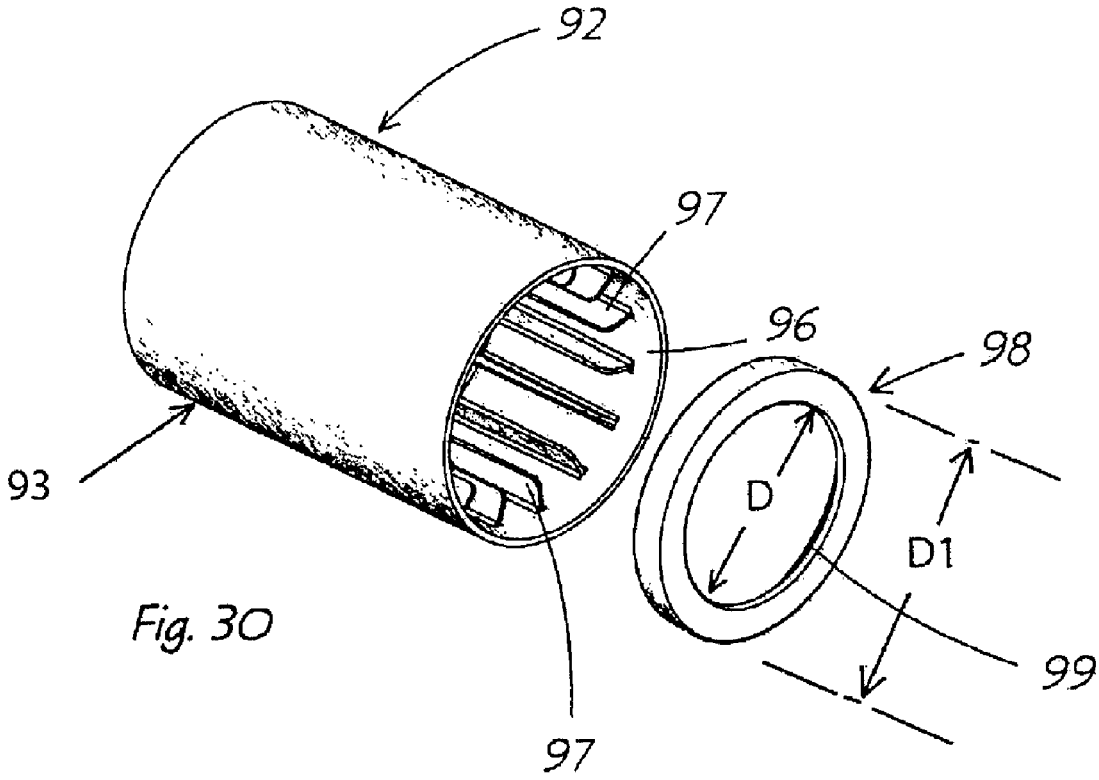
FIG. 30 is an exploded perspective view of the hub of FIG. 29.

A fifth embodiment of the polarized tape dispenser is indicated generally at 90, and shown in FIGS. 28-30. Embodiment 90 includes a tape roll 19 and a two-piece hub indicated generally at 92. Hub 92 includes a cylindrical-shaped body 93 having an outer cylindrical surface 94 about which the tape is wound, which terminates in open ends 95 and 96. An annular end member 98 has an outer diameter $D_1$ enabling it to be telescopically slidably mounted within the interior of open end 96 of body 93 as shown in FIG. 28, which has a complementary diameter $D_1$ so as to be slidably engaged and joined therewith. End member 98 has an inner opening 99 which is complementary to the outside diameter D of hub mount 11 so as to be slidably engaged therewith as shown in FIG. 28. End opening 95 of body 93 has an inner diameter $D_1$ which is complementary to the outer diameter of hub mount 13 so as to be slidably, rotatably mounted thereon. Again, a plurality of circumferentially spaced radially inwardly extending flanges 97 are formed on the inside surface of hub body 94 to provide rigidity thereto. Also, flanges 97 have an axial length less than the axial length of body 94 so as not to interfere with hub mounts 11 and 13 as shown in FIG. 28. This embodiment requires only a two-piece component to form the internal hub.

In summary, the various embodiments shown above, including other modifications which could be made thereto, provide for a one, two, or three piece internal hub 57 which can be telescopically mounted within the bore of a tape reel, or provide a cylindrical outer surface on which the adhesive tape is wound which hubs provide two different diameter end openings which are complementary to two different sized diameter hub mounts formed on the spaced inner surfaces of a tape dispenser frame, insuring that the tape roll can be mounted correctly in one manner on the frame to insure that the adhesive side of the tape is properly oriented with respect to the dispenser. Furthermore, some of the embodiments enable the tape to be wound on the hub by existing winding machines since it has the same shape and size as that of the hubs used with frames hub mounts, and/or enables reduced inventory to be achieved by the various one-piece hub embodiments shown and described above.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention are an example and the invention is not limited to the exact details shown or described.

The invention claimed is:

1. A tape dispenser for dispensing adhesive tape from a roll, said tape dispenser comprising:

a housing having a first and a second side wall;

a first hub mount being of a first diameter and extending inwardly from the first side wall;

a second hub mount being of a second and smaller diameter, and extending inwardly from the second side wall;

a hub member adapted to retain a roll of tape thereon and comprising a generally cylindrical body having an interior surface and open first and second ends with a longitudinal axis extending therebetween; and wherein each of said first and second ends is of an interior third diameter that is small enough to fittingly engage the first hub mount and too large to fittingly engage the second hub mount; and wherein the body further includes at least one flange extending radially inwardly from the interior surface thereof, and said flange has a terminal end spaced a distance inwardly from the second end of the body; and an annular end member having an external diameter substantially equal to the third diameter, said annular end member being oriented so that it is coaxial with the body and is engageable with the second end thereof, whereby the first end of the body is engageable with the first hub mount and the annular end member is engageable with the second hub mount.

2. The tape dispenser as defined in claim 1, wherein the first diameter and the third diameter are substantially equal.

3. The tape dispenser as defined in claim 1, wherein the distance from the terminal end of the flange to the second end of the body is substantially equal to the thickness of the annular end member, whereby an outer surface of the annular end member is substantially flush with the second end of the body.

4. The tape dispenser as defined in claim 3, wherein the body has a plurality of flanges extending radially inwardly from the interior surface thereof, and each of said flanges has a terminal end positioned a spaced distance inwardly from the second end of the body.

5. The tape dispenser as defined in claim 4, wherein the flanges are elongate members that are aligned substantially parallel to the longitudinal axis of the body, and each flange extends from its terminal end to a position spaced a distance inwardly from the first end of the body.

6. The tape dispenser as defined in claim 5, wherein the flanges are circumferentially spaced apart from each other.

7. The tape dispenser as defined in claim 1, wherein the interior surface at the first end of the body abuts an exterior circumferential surface of the first hub mount and is able to rotate thereon; and an interior surface of the annular end member abuts an external circumferential surface of the second hub mount and is able to rotate thereon.

8. The tape dispenser as defined in claim 1, wherein the annular end member is slidably received with the second end of the body.

9. In combination, a tape dispenser comprising:

a housing having a first and a second side wall;

a first hub mount being of a first diameter and extending inwardly from the first side wall;

a second hub mount being of a second and smaller diameter and extending inwardly from the second side wall;

a hub member comprising a generally cylindrical body having an interior surface and open first and second ends, each of said first and second ends being of an interior third diameter that is small enough to fittingly engage the first hub mount and too large to fittingly engage the second hub mount; wherein the body further includes at least one flange extending radially inwardly from the interior surface thereof, and said flange has a terminal end spaced a distance inwardly from the second end of the body;

a annular end member having an external diameter substantially equal to the third diameter and an internal diameter substantially equal to the second diameter; said annular end member being engageable with the second end of the body, whereby the first end of the body is engageable with the first hub mount and the annular end member is engageable with the second hub mount; and a roll of tape received around an exterior surface of said hub member of the tape dispenser.

10. The combination as defined in claim 9, wherein the body has a longitudinal axis extending between the first and second ends thereof and the annular end member is oriented so that it is coaxial with the body.

11. The combination as defined in claim 9, wherein the first diameter and the third diameter are substantially equal.

12. The combination as defined in claim 9, wherein the distance from the terminal end of the flange to the second end of the body is substantially equal to the thickness of the annular end member, whereby an outer surface of the annular end member is substantially flush with the second end of the body.

13. The combination as defined in claim 9, wherein the body has a plurality of flanges extending radially inwardly from the interior surface thereof, and each of said flanges has a terminal end positioned a spaced distance inwardly from the second end of the body.

14. The combination as defined in claim 13, wherein the flanges are elongate members that are aligned substantially parallel to the longitudinal axis of the body, and each flange extends from its terminal end to a position spaced a distance inwardly from the first end of the body.

15. The combination as defined in claim 14, wherein the flanges are circumferentially spaced apart from each other.

16. The combination as defined in claim 9, wherein the interior surface at the first end of the body abuts an exterior circumferential surface of the first hub mount and is able to rotate thereon; and an interior surface of the annular end member abuts an external circumferential surface of the second hub mount and is able to rotate thereon.

17. The combination as defined in claim 9, wherein the annular end member is slidably received with the second end of the body.

* * * * *